US009464789B2

(12) United States Patent
Chien et al.

(10) Patent No.: US 9,464,789 B2
(45) Date of Patent: Oct. 11, 2016

(54) MODULAR LED EXPLOSION-PROOF LAMP

(71) Applicant: Li-Hong Science & Technology Co., Ltd., Kaohsiung (TW)

(72) Inventors: Ming-Tien Chien, Kaohsiung (TW); Ching-Yuan Juan, Kaohsiung (TW); Han-Wen Chang, Kaohsiung (TW)

(73) Assignee: LI-HONG SCIENCE & TECHNOLOGY CO., LTD, Kaohsiung (TW)

( * ) Notice: Subject to any disclaimer, the term of this patent is extended or adjusted under 35 U.S.C. 154(b) by 231 days.

(21) Appl. No.: 14/488,718

(22) Filed: Sep. 17, 2014

(65) Prior Publication Data

US 2015/0362156 A1 Dec. 17, 2015

(30) Foreign Application Priority Data

Jun. 12, 2014 (TW) ..... 103120295 A

(51) Int. Cl.

| | |
|---|---|
| ***F21V 25/12*** | (2006.01) |
| ***F21V 17/00*** | (2006.01) |
| ***F21V 23/00*** | (2015.01) |
| ***F21V 17/12*** | (2006.01) |
| ***F21V 31/00*** | (2006.01) |
| ***F21V 29/10*** | (2015.01) |
| *F21Y 101/02* | (2006.01) |
| *F21W 131/402* | (2006.01) |

(52) U.S. Cl.

CPC ..... *F21V 17/002* (2013.01); *F21V 17/12* (2013.01); *F21V 23/008* (2013.01); *F21V 25/12* (2013.01); *F21V 29/10* (2015.01); *F21V 31/005* (2013.01); *F21W 2131/402* (2013.01); *F21Y 2101/02* (2013.01)

(58) Field of Classification Search

CPC .... F21V 25/12; F21V 17/002; F21V 31/005; F21V 23/008

See application file for complete search history.

(56) References Cited

U.S. PATENT DOCUMENTS

| | | | | | |
|---|---|---|---|---|---|
| 3,209,138 | A * | 9/1965 | Moore | F21L 14/00 | 174/50.5 |
| 4,142,179 | A * | 2/1979 | Lowndes | B60Q 7/00 | 174/17 VA |
| 4,156,891 | A * | 5/1979 | Roche | F21S 9/022 | 307/66 |
| 4,158,880 | A * | 6/1979 | McJunkin, Jr. | F21V 17/12 | 362/164 |
| 4,186,432 | A * | 1/1980 | Hamacher | F21V 19/04 | 313/49 |
| 4,283,758 | A * | 8/1981 | Irving | F21V 25/12 | 362/234 |
| 4,388,681 | A * | 6/1983 | Meyer | F21V 23/02 | 362/267 |
| 4,425,609 | A * | 1/1984 | Grindle | F21V 25/12 | 285/355 |

(Continued)

*Primary Examiner* — Anh Mai
*Assistant Examiner* — Zachary J Snyder
(74) *Attorney, Agent, or Firm* — Muncy, Geissler, Olds & Lowe, P.C.

(57) ABSTRACT

A modular LED explosion-proof lamp usable in any environment includes a body, a wiring box assembly, an illumination unit and a positioning assembly. The body includes a first coupling port, a second coupling port and a third coupling port. The wiring box assembly is connected to the first coupling port, or the second coupling port or the third coupling port. The illumination unit is connected to the first coupling port, or the second coupling port or the third coupling port. The positioning assembly is connected to the first coupling port, or the second coupling port or the third coupling port. Hence the wiring box assembly, the illumination unit or the positioning assembly can be selectively connected to the first coupling port, or the second coupling port or the third coupling port. Thus the modular LED explosion-proof lamp can be assembled in a plurality of implementation fashions.

10 Claims, 13 Drawing Sheets

(56) References Cited

U.S. PATENT DOCUMENTS 4,463,398 A * 7/1984 Boozer ..... F21V 23/00 340/815.5
4,613,931 A * 9/1986 Messinger ..... G02B 6/0006 362/158
4,841,418 A * 6/1989 Davis ..... F21V 19/0095 362/219
4,937,717 A * 6/1990 Betzvog, Jr. ..... F21V 25/12 362/264
5,012,395 A * 4/1991 Wettengel et al. ... F21V 15/013 362/222
5,043,853 A * 8/1991 Rutledge ..... F21V 19/04 362/221
5,140,216 A * 8/1992 Darr ..... F21L 14/026 313/25
5,379,195 A * 1/1995 Epstein ..... F21V 25/12 362/183
5,534,664 A * 7/1996 Fearing, Jr. ..... F21V 19/04 174/50
5,908,236 A * 6/1999 Lueken ..... F21S 8/022 362/153
5,911,499 A * 6/1999 Stafford ..... F21S 9/022 362/147
6,000,819 A * 12/1999 Graber ..... F21V 25/12 362/263
6,095,662 A * 8/2000 Burroughs ..... F21S 9/00 362/235
2003/0021104 A1* 1/2003 Tsao ..... F21S 8/024 362/95
2007/0081345 A1* 4/2007 Wilcox ..... F21V 23/026 362/382
2009/0080193 A1* 3/2009 Peck ..... F21V 21/116 362/249.02
2009/0135607 A1* 5/2009 Holloway ..... F21V 25/12 362/362
2009/0184646 A1* 7/2009 Devaney ..... F21L 4/027 315/113
2011/0121734 A1* 5/2011 Pape ..... F21V 25/12 315/86
2012/0195041 A1* 8/2012 Fletcher ..... F21V 29/773 362/249.02
2013/0314921 A1* 11/2013 Chen ..... F21V 29/20 362/249.02
2014/0347846 A1* 11/2014 Ahn ..... F21S 8/036 362/147
2015/0131287 A1* 5/2015 Marsh ..... F21V 19/04 362/260
2015/0204521 A1* 7/2015 Zhang ..... F21V 23/06 362/294
2015/0354794 A1* 12/2015 Guercio ..... F21V 21/30 362/235
2015/0362155 A1* 12/2015 Thomsen ..... F21V 15/01 362/268

* cited by examiner

MODULAR LED EXPLOSION-PROOF LAMP

FIELD OF THE INVENTION

The present invention relates to a modular LED explosion-proof lamp and particularly to a modularized LED explosion-proof lamp that can be assembled and implemented in varying fashions.

BACKGROUND OF THE INVENTION

On industrial sites such as chemical industry, petrochemical industry, oilfields, coalmines and the like where gases, dust or chemicals with characteristics of inflammable, easy explosion, oxidization or corrosion are often scattering or stored, explosion-proof lamps must be used to avoid explosion incidents caused by sparks generated by worn out or malfunction of ordinary lamps that are not explosion-proof.

Conventional explosion-proof lamps that are assembled and installed on different sites have to be formed individually according to requirements of each site, and often cannot be used at other sites of different explosion environments. In the event that the required LED explosion-proof lamp is short in supply and no other LED explosion-proof lamp can be used for substitute, it has to be made with extra time and production cost. Moreover, when a LED explosion-proof lamp is damaged and the damaged portion cannot be disassembled and removed separately for repairs, making repairs is a time consuming and tedious task for operation people. All this shows that there are still lot of rooms for improvement on the conventional LED explosion-proof lamps.

SUMMARY OF THE INVENTION

The primary object of the present invention is to overcome the problem of the conventional LED explosion-proof lamps of cannot be assembled and implemented in various fashions when in use.

To achieve the foregoing object the invention provides a modular LED explosion-proof lamp which includes a body, an electrical control assembly, a wiring box assembly, an illumination unit and a positioning assembly. The body includes a first chamber, a front protruding coupling portion located at one end of the body and connected to the first chamber, a rear protruding coupling portion opposite to the front protruding coupling portion and connected to the first chamber, two parallel transverse support portions connected respectively to the front protruding coupling portion, the rear protruding coupling portion and the first chamber, and two parallel upright support portions connected respectively to the front protruding coupling portion, the rear protruding coupling portion and the first chamber. The front protruding coupling portion includes an opening communicating with the first chamber. One transverse support portion includes a first coupling port communicating with the first chamber. The rear protruding coupling portion includes a second coupling port communicating with the first chamber. Another transverse support portion includes a third coupling port communicating with the first chamber. The first, second and third coupling ports are formed at a same diameter. The electrical control assembly is located in the first chamber. The wiring box assembly is connected to the first coupling port, or the second coupling port or the third coupling port. The illumination unit includes an illumination device and a connection means. The illumination device includes a base and an illumination element connected to one end of the base. The connection means includes a tube which has two ends formed respectively a first coupling portion connected to the first coupling port, or the second coupling port or the third coupling port, and a second coupling portion connected to one end of the base remote from the illumination element. The positioning assembly includes a first protruding plate which has a first protruding portion connected to the first coupling port, or the second coupling port or the third coupling port.

The invention thus formed provides many advantageous features, notably:

1. The body, with the first coupling port, the second coupling port and the third coupling port formed thereon at the same diameter, can be coupled respectively with the wiring box assembly, or the illumination unit or the positioning assembly according to requirements at assembly and installation sites, thus the LED explosion-proof lamp can be implemented in various fashions.

2. With the first coupling port, the second coupling port and the third coupling port of the same diameter formed on the body, assembly and installation of the wiring box assembly, the illumination unit or the positioning assembly is simpler, and repairs also can be done individually easier to reduce repairs and maintenance costs.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
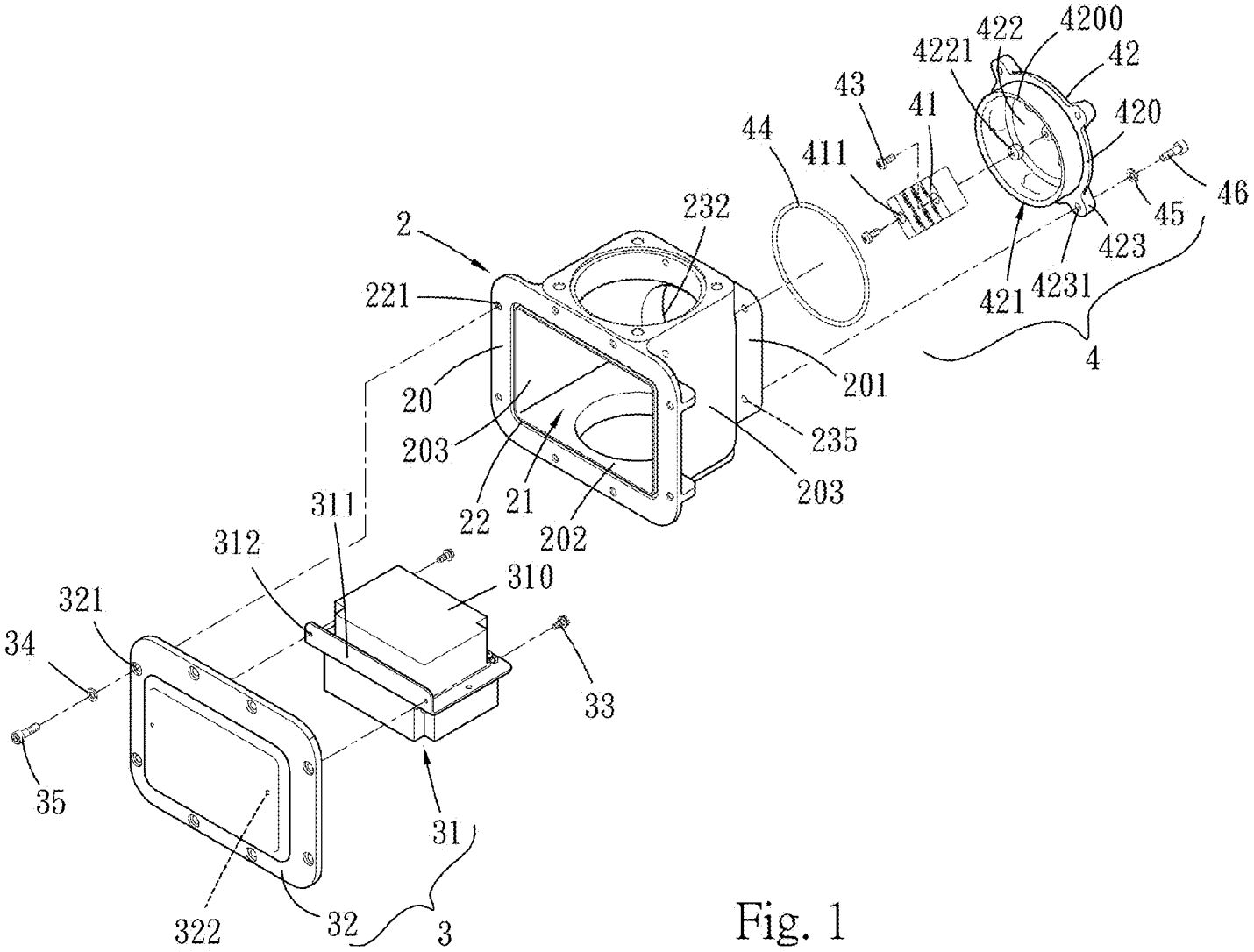
FIG. 1 is an exploded view of the body, electrical control assembly and wiring box assembly of the invention.

The present invention aims to provide a modular LED explosion-proof lamp 1 that can be assembled and installed in various implementation fashions, please referring to FIGS. 1, 6, 7, 9 and 11.

Please refer to FIGS. 1 through 5 for a first embodiment of the invention. The LED explosion-proof lamp 1 includes a body 2, an electrical control assembly 3, a wiring box assembly 4, an illumination unit 5 and a positioning assembly 6. The body 2 includes a first chamber 21, a front protruding coupling portion 20 located at one end of the body 2 and connected to the first chamber 21, a rear protruding coupling portion 201 opposite to the front protruding coupling portion 20 and connected to the first chamber 21, two parallel transverse support portions 202 connected respectively to the front protruding coupling portion 20 and the rear protruding coupling portion 201 and the first chamber 21, and two parallel upright support portions 203 connected respectively to the front protruding coupling portion 20, the rear protruding coupling portion 201, the two transverse support portions 202 and the first chamber 21. The front protruding coupling portion 20 includes a rectangular opening 22 communicating with the first chamber 21 and a plurality of fourth fastening holes 221 located on the front protruding coupling portion 20 and abutting the opening 22. The rear protruding coupling portion 201 includes a second coupling port 232 communicating with the first chamber 21 and a plurality of second fastening holes 235 located thereon and abutting the second coupling port 232. The transverse support portion 202 at the lower end of the body 2 has a first coupling port 231 communicating with the first chamber 21 and a plurality of first fastening holes 234 located thereon and abutting the first coupling port 231. Another transverse support portion 202 at the upper end of the body 2 has a third coupling port 233 communicating with the first chamber 21 and a plurality of third fastening holes 236 located thereon and abutting the third coupling port 233. In this embodiment the first coupling port 231, the second coupling port 232 and the third coupling port 233 are circular holes and formed at a same diameter. But this is not the limitation of the invention. One of the first coupling port 231, the second coupling port 232 and the third coupling port 233 can be selected to connect to either the wiring box assembly 4, the illumination unit 5 or the positioning assembly 6.

The electrical control assembly 3 includes a power ballast 31 located in the first chamber 21 and a cover plate 32 to cover the opening 22 and fasten to the front protruding coupling portion 20. Furthermore, the power ballast 31 includes a stabilizer 310 located in the first chamber 21 and an anchor plate 311 connected to the stabilizer 310 and faced the cover plate 32 and fastened thereon. The anchor plate 311 includes fifth fastening holes 312 located at two sides thereof. The cover plate 32 Includes a plurality of sixth fastening holes 321 facing the fourth fastening holes 221, and a plurality of seventh fastening holes 322 facing the fifth fastening holes 312, and a plurality of first fasteners 33 each runs through each fifth fastening hole 312 and each seventh fastening hole 322 for fastening therewith, and a plurality of second fasteners 35 each runs through a first washer 34 and each sixth fastening hole 321 to fasten to each fourth fastening hole 221. Thus, the cover plate 32 can cover the opening 22 and be fastened to the front protruding portion 20 to securely hold the power ballast 31.

The wiring box assembly 4 includes a power terminal deck 41, a cap 42 to hold the power terminal deck 41 and a first connection ring 44 to bridge the cap 42 and the rear protruding coupling portion 201. The power terminal deck 41 has at least one eighth fastening hole 411. The cap 42 includes a leaning portion 420 leaned on the surface of the rear protruding coupling portion 201, a second protruding portion 4200 connected to the leaning portion 420 and faced the second coupling port 232 for coupling therewith, a second chamber 421 facing the second protruding portion 4200 inward to hold the power terminal deck 41, and at least one fastening portion 422 faced and extended to the second chamber 421. The leaning portion 420 has a plurality of first lugs 423 extended outwards, a ninth fastening hole 4231 formed on each first lug 423 toward each second fastening hole 235 and a plurality of third fasteners 46 each runs through one second washer 45 and each ninth fastening hole 4231 to fasten to each second fastening hole 235. The fastening portion 422 has at least one tenth fastening hole 4221 faced the eighth fastening hole 411 and at least one fourth fastener 43 run through the eighth fastening hole 411 and fastened to the tenth fastening hole 4221, thereby can fasten the power terminal deck 41 in the second chamber 421. The first connection ring 44 leans on the rear protruding coupling portion 201 and the second protruding portion 4200 to form sealing thereof. In this embodiment the eighth fastening hole 411, the tenth fastening hole 4221 and the fourth fastener 43 include respectively, but not limited to, two sets. In the first embodiment the wiring box assembly 4 is installed on the second coupling port 232, but also can be installed on the first coupling port 231 or the third coupling port 233 in other embodiments, but this also is not the limitation of the invention.

The illumination unit 5 includes an illumination device 50 and a connection means 51. The illumination device 50 includes a base 501 and an illumination element 500 connected to one end of the base 501. The base 501 has a first fastening portion 502 located in the middle at one end remote from the illumination element 500 and a plurality of fifth fasteners 508 located outside the first fastening portion 502 to fasten the illumination element 500 to the base 501. The first fastening portion 502 has a third chamber 503, a coupling port 504 communicating with the third chamber 503, a coupling flange 505 connected to an outer side of the coupling port 504, a plurality of second lugs 506 located on the coupling flange 505 and extended outward, and an eleventh fastening hole 507 located on each second lug 506. The connection device 51 includes a hollow elongated tube 52 to bridge the illumination device 50 and the first coupling port 231, a second connection ring 536 to bridge an upper end of the tube 52 and the transverse support portion 202 at the lower side of the body 2, and a third connection ring 546 to bridge a lower end of the tube 52 and the first fastening portion 502. The tube 52 has two ends formed respectively a first coupling portion 53 connected to the first coupling port 231 and a second coupling portion 54 connected to the first fastening portion 502 of the base 501. The first coupling portion 53 has a second protruding plate 531 leaned on the transverse support portion 202 at the lower side of the body 2, a plurality of twelfth fastening holes 532 formed on the second protruding plate 531 to face the first fastening holes 234, a third protruding portion 533 connected to the second protruding plate 531 to couple with the first coupling port 231, a fourth chamber 534 faced the third protruding portion 533 inward, a screw hole 535 faced the fourth chamber 534, and a plurality of sixth fasteners 538 each runs through a third washer 537 and each twelfth fastening hole 532 to fasten to each first fastening hole 234, so that the second protruding plate 531 can be fastened to the transverse support portion 202 at the lower side of the body 2. The second coupling portion 54 has a third protruding plate 541 leaned on the coupling flange 505 of the base 501, a plurality of thirteenth fastening holes 542 located on the third protruding plate 541 and faced the eleventh fastening holes 507, a fourth protruding portion 543 connected to the third protruding plate 541 and faced the coupling port 504 to couple therewith and held in the third chamber 503, a fifth chamber 544 opened toward the fourth protruding portion 543, a screw hole 545 faced the fifth chamber 544 and a plurality of seventh fasteners 548 each runs through a fourth washer 547 and each thirteenth fastening hole 542 to fasten to each eleventh fastening hole 507 so that the third protruding plate 541 can be fastened to the coupling flange 505. The second connection ring 536 leans on the transverse support portion 202 at the lower side of the body 2 and the third protruding portion 533 to form sealing thereof. The third connection ring 546 leans on the fourth protruding portion 543 and the first fastening portion 502 to form sealing thereof. In this embodiment the illumination element 500 is, but not limited to, a LED lamp. In the first embodiment the connection device 51 is assembled on the first coupling port 231 via the first coupling portion 53 of the tube 52; in other embodiments the first coupling portion 53 also can be installed on the second coupling port 232 or the third coupling port 233, but this also is not the limitation of the invention.

The positioning assembly 6 includes a first protruding plate 61 leaned on the transverse support portion 202 at the upper side of the body 2, a fourth connection ring 613 to bridge the first protruding plate 61 and the transverse support portion 202 mentioned above, a holding base 62 connected to an upper end of the first protruding plate 61, and a holding plate 63 connected to an upper end of the holding base 62 and fastened to a ceiling A1. Furthermore, the first protruding plate 61 includes a first protruding portion 611 connected to the first protruding plate 61 and coupled on the third coupling port 233, a plurality of fourteenth fastening holes 612 located thereon and faced the third fastening holes 236, and a plurality of eighth fasteners 615 each runs through a fifth washer 614 and each fourteenth fastening hole 612 to fasten to each third fastening hole 236 so that the first protruding plate 61 can be fastened to the transverse support portion 202 at the upper side of the body 2. The fourth connection ring 613 leans on the transverse support portion 202 mentioned above and the first protruding portion 611 to form sealing thereof. The holding base 62 includes a plurality of protruding circular portions 620 on each side thereof and a second fastening portion 621 on the upper surface of the holding base 62. The second fastening portion 621 has a plurality of fifteenth fastening holes 622 formed at four corners thereof. The holding plate 63 includes a third fastening portion 631 located in the middle thereof and two fourth fastening portions 632 bent and connected to two sides of the third fastening portion 631. The third fastening portion 631 has a plurality of sixteenth fastening holes 633 faced the fifteenth fastening holes 622 and a plurality of ninth fasteners 635 each runs through a sixth washer 634 and each sixteenth fastening hole 633 to fasten to each fifteenth fastening hole 622. The fourth fastening portion 632 has a plurality of seventeenth fastening holes 637 and a plurality of tenth fasteners 636 each runs through each seventeenth fastening hole 637 to fasten to the ceiling A1. In addition, in the first embodiment the positioning assembly 6 can be installed on the third coupling port 233 through the first protruding portion 611 of the first protruding plate 61. In other embodiments the first protruding portion 611 also can be installed on the first coupling port 231 or the second coupling port 232, but this is not the limitation of the invention.

Figure 2:
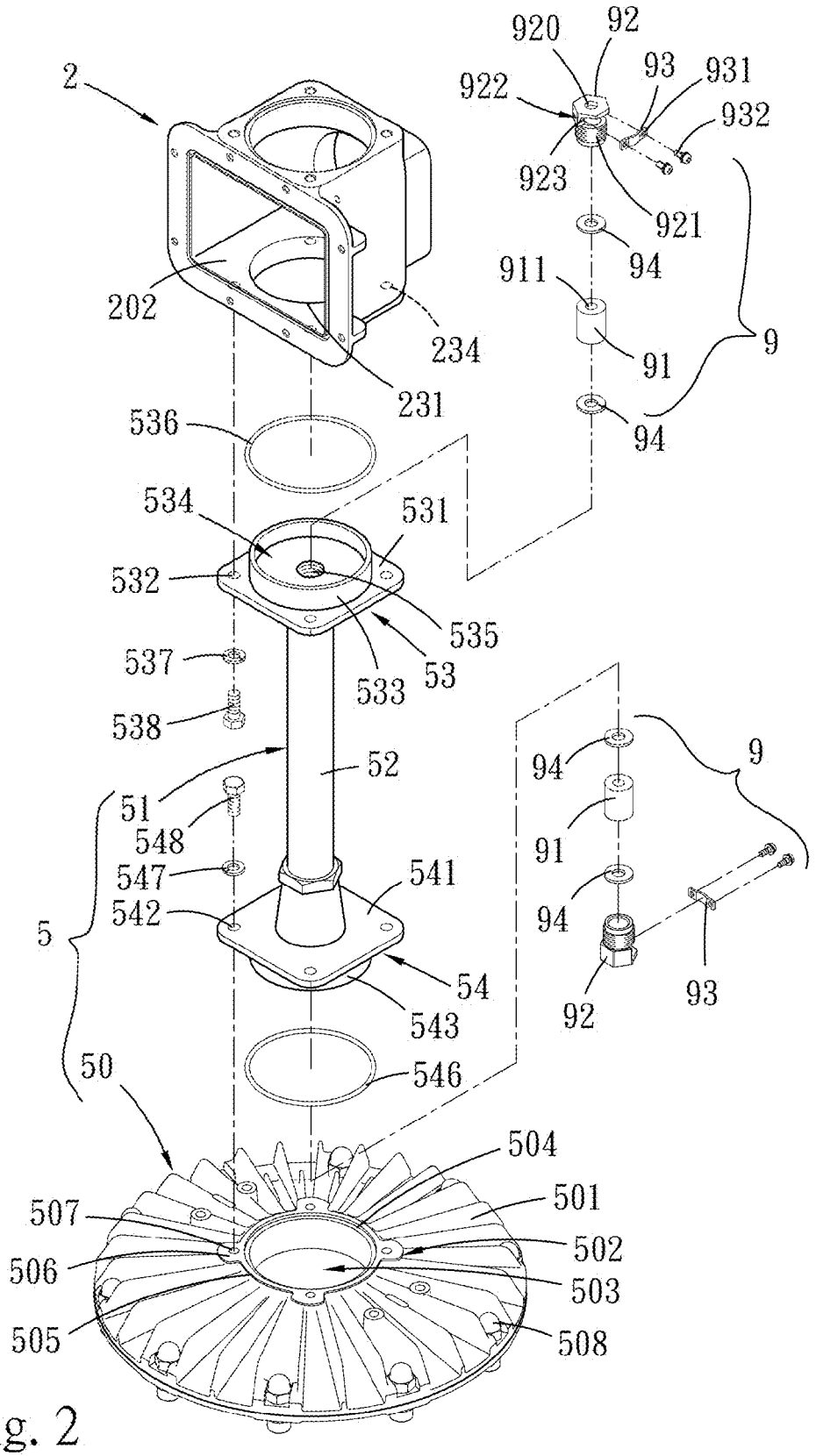
FIG. 2 is an exploded view of the body, illumination unit and cable sealing means of the invention.
Figure 3:
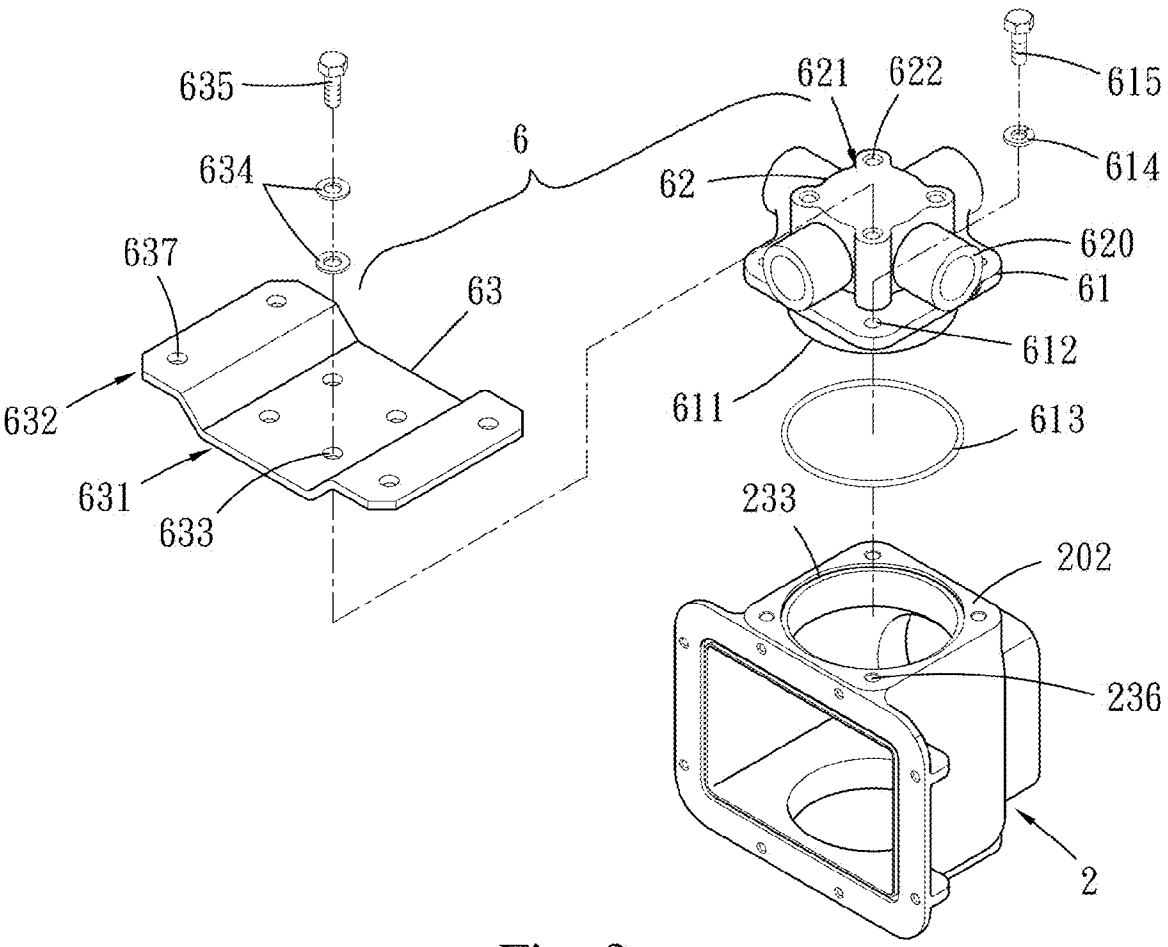
FIG. 3 is an exploded view of the body and positioning assembly of the invention.
Figure 4A:
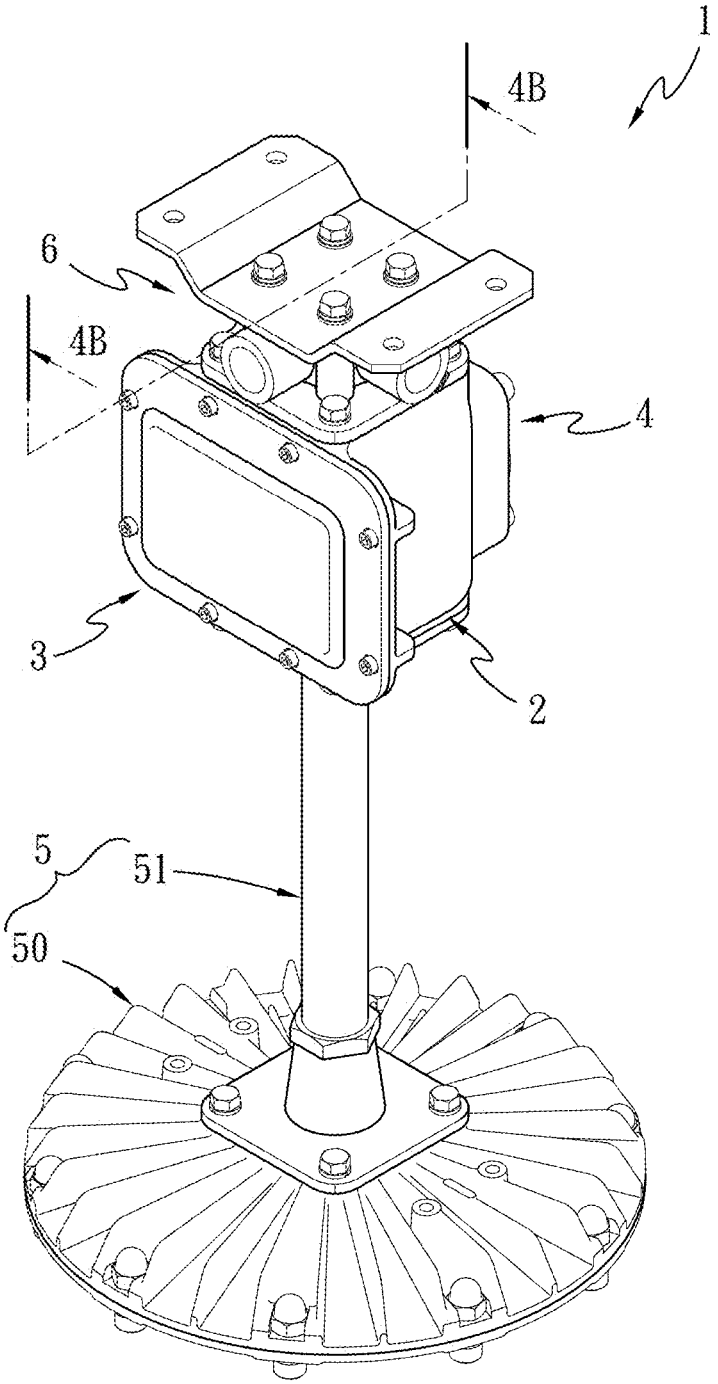
FIG. 4A is a perspective view of a first embodiment of the invention in an assembly condition.
Figure 4B:
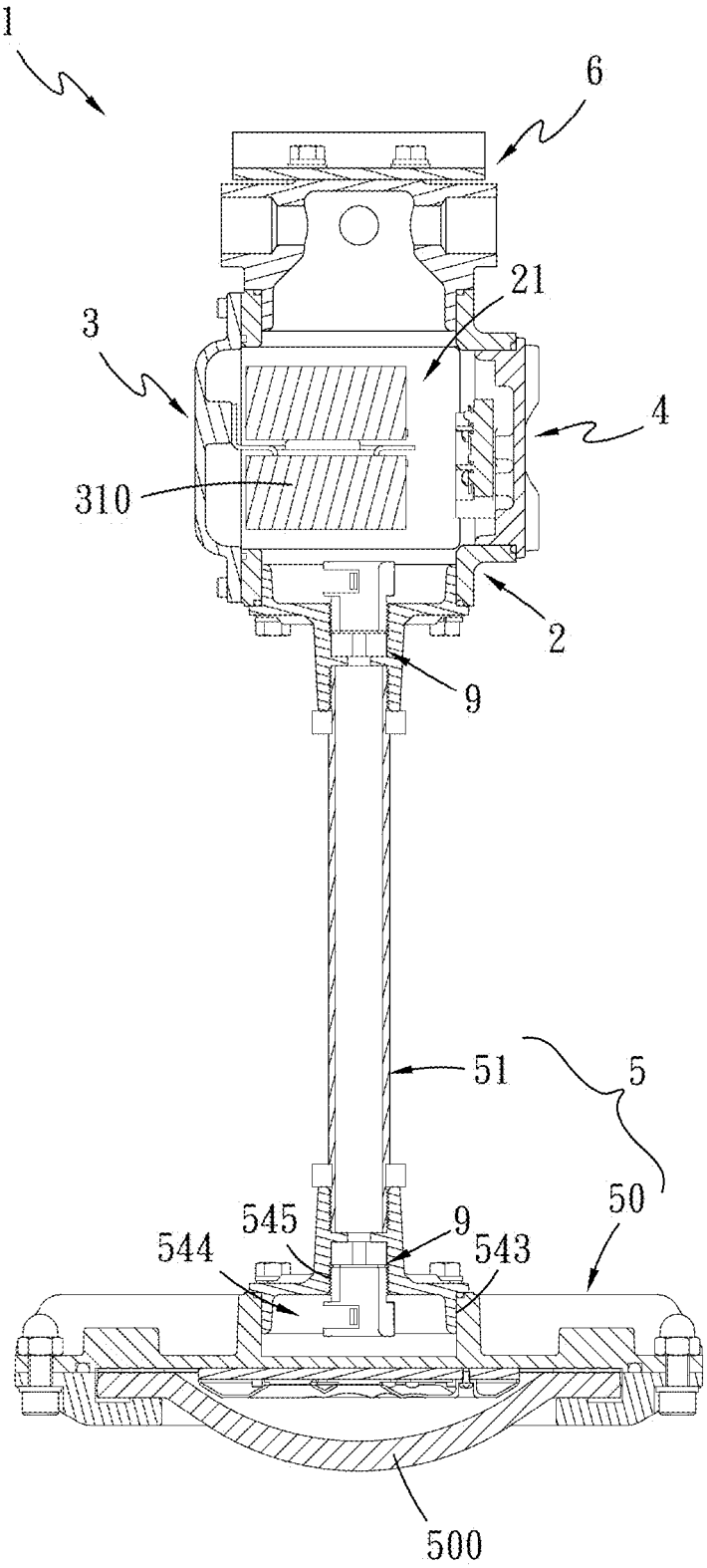
FIGS. 4B is a sectional view taken on line 4B-4B in FIG. 4A.
Figure 5:
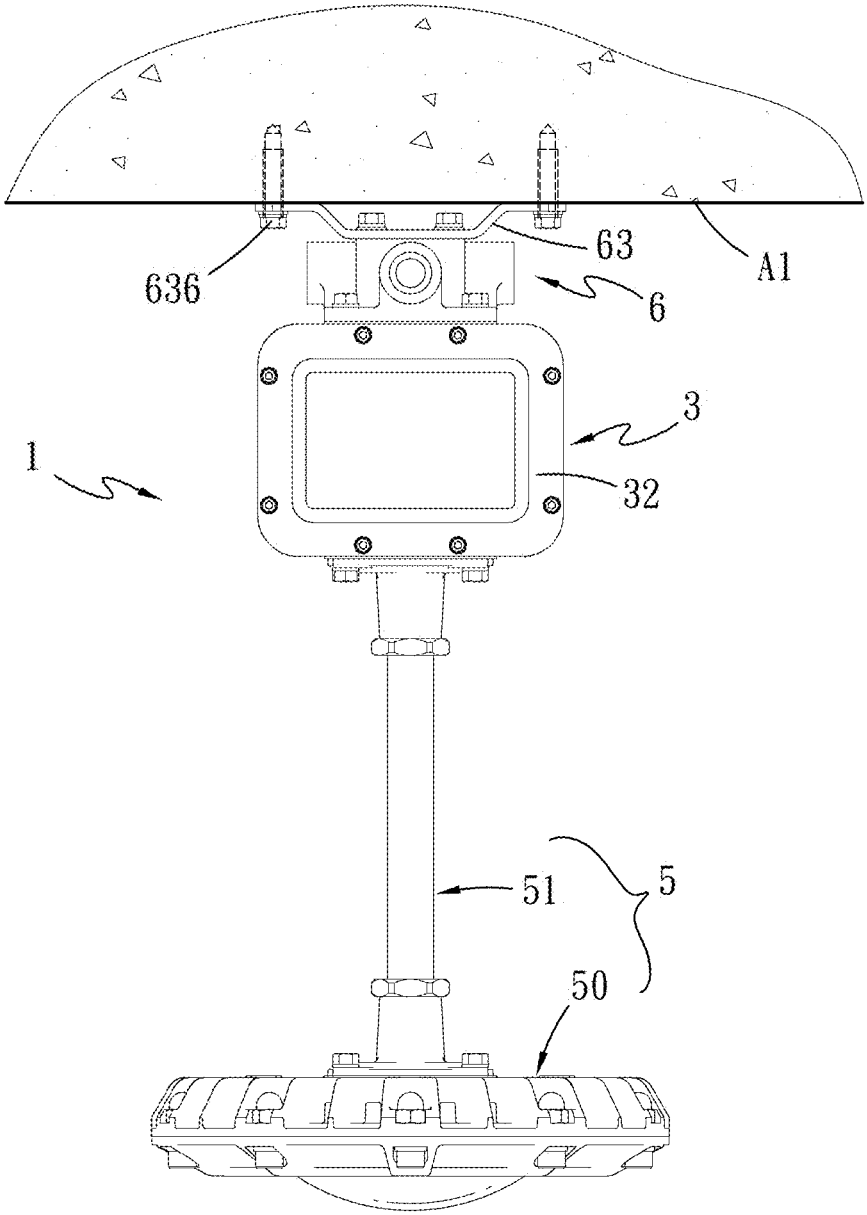
FIG. 5 is a perspective view of the first embodiment of the invention.

Please referring to FIG. 2, in order to avoid the body 2 and the illumination unit 5 from generating and exposing sparks that might produce hazardous incident of explosion, the screw hole 535 of the first coupling portion 53 and the screw hole 545 of the second coupling portion 54 are screwed respectively with, but not limited to, a cable sealing means 9. The cable sealing means 9 includes a compression element 91 located in the screw holes 535 and 545, at least two washers 94 located in the screw holes 535 and 545 to press two ends of the compression element 91, a compact plug 92 pressed one end of the compression element 91 abutting the fourth chamber 534 or the fifth chamber 544, and a clip element 93 connecting to the compact plug 92. The compression element 91 has a first aperture 911 run through two ends thereof. The compact plug 92 has a second aperture 920 run through two ends thereof, a screw thread 921 screwed with the screw holes 535 and 545, and a clamping indented portion 922 to hold the clip element 93. The indented portion 922 has two eighteenth fastening holes 923 formed at two ends thereof. The clip element 93 has two nineteenth fastening holes 931 located at two ends thereof to face the eighteenth fastening holes 923, and a plurality of eleventh fasteners 932 each runs through each nineteenth fastening hole 931 and fastens to each eighteenth fastening hole 923. In this embodiment the compression element 91 is an explosion-proof rubber ring, and the compact plug 92 is a metal plug, but these are not the limitation of the invention. Furthermore, the cable sealing means 9 is a sealed device which can withstand explosion of special gases or steam inside, and also prohibit explosion caused by sparks in the interior, flying arc or gases that might otherwise cause burning of combustible gases in the ambience. Moreover, the body 2, the power ballast 31, the power terminal deck 41 and the illumination element 500 are electrically connected with each other.

Figure 6:
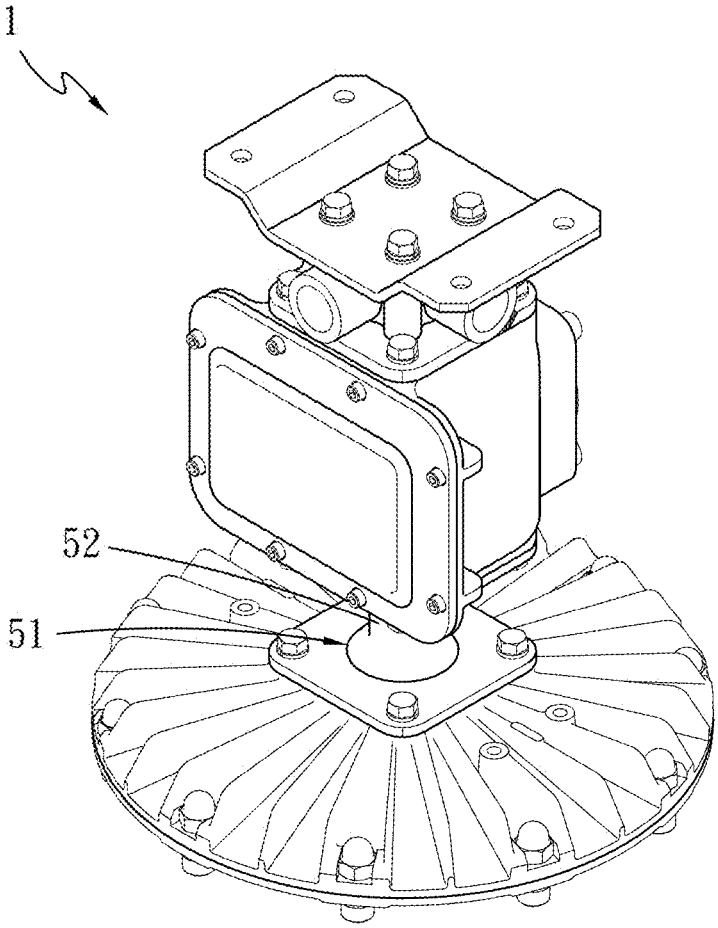
FIG. 6 is a perspective view of a second embodiment of the invention in an assembly condition.
Figure 7:
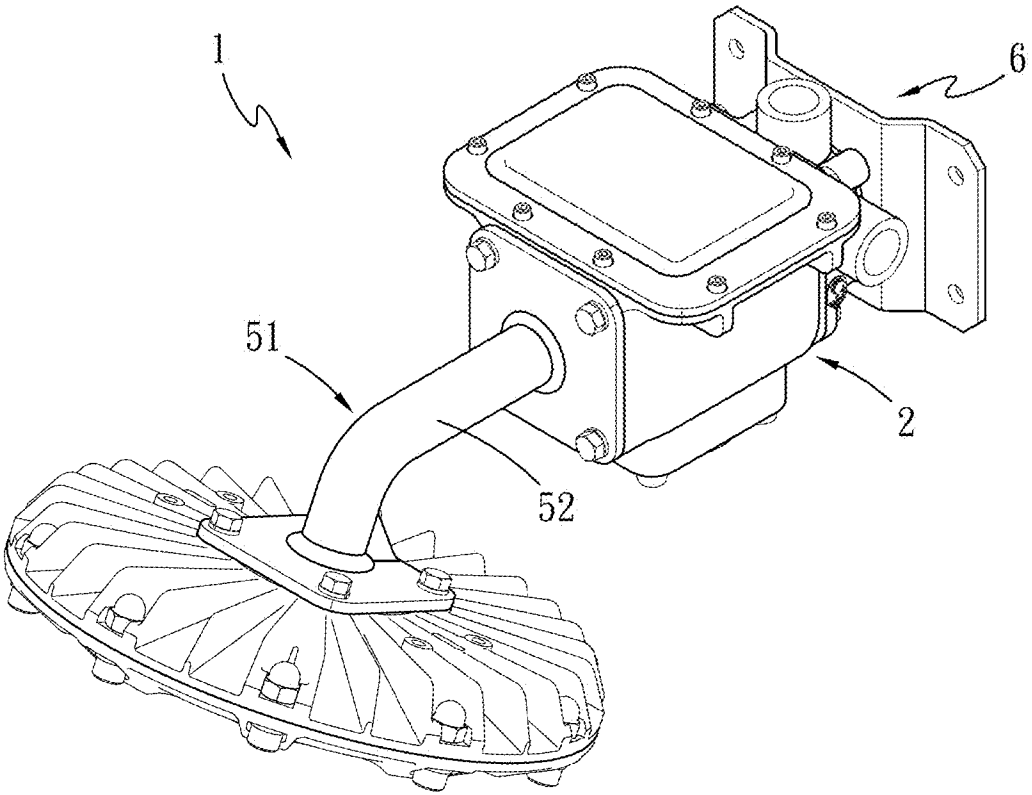
FIG. 7 is a perspective view of a third embodiment of the invention in an assembly condition.
Figure 8:
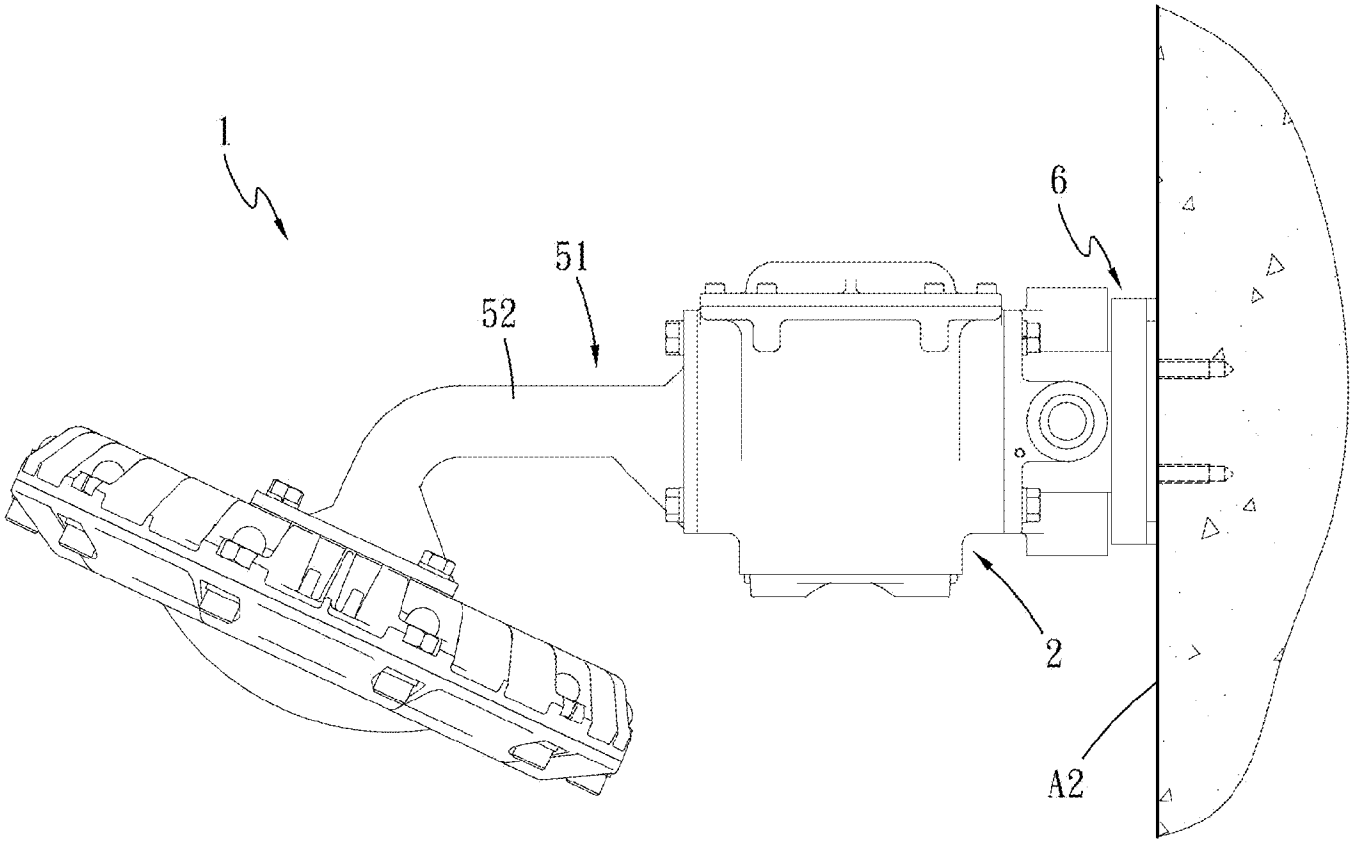
FIG. 8 is a perspective view of the third embodiment of the invention.

Please refer to FIGS. 6 through 8 for a second embodiment and a third embodiment of the modular LED explosion-proof lamp 1 of the invention. The second embodiment differs from the first embodiment by the connection length of the tube 52 of the connection means 51. As shown in FIG. 6, the first or second embodiment can be selected and implemented according to different location elevations. The third embodiment differs from the first embodiment by the type of tube 52 being used as shown in FIGS. 7 and 8. The tube 52 in the third embodiment is formed in a hollow arched shape. Thus, one end of the positioning assembly 6 remote from the body 2 can be fastened to a wall A2 to facilitate operation at a lower elevation. Thus, in practice the first, second or third embodiment can be selected according to requirements to facilitate operation at different sites. The coupling relationship of the elements in the second and third embodiments are same as that of the first embodiment, hence details are omitted herein. In the embodiments of the invention the tube 52 can be a hollow post or a hollow arched tube, but this is not the limitation of the invention.

Figure 9:
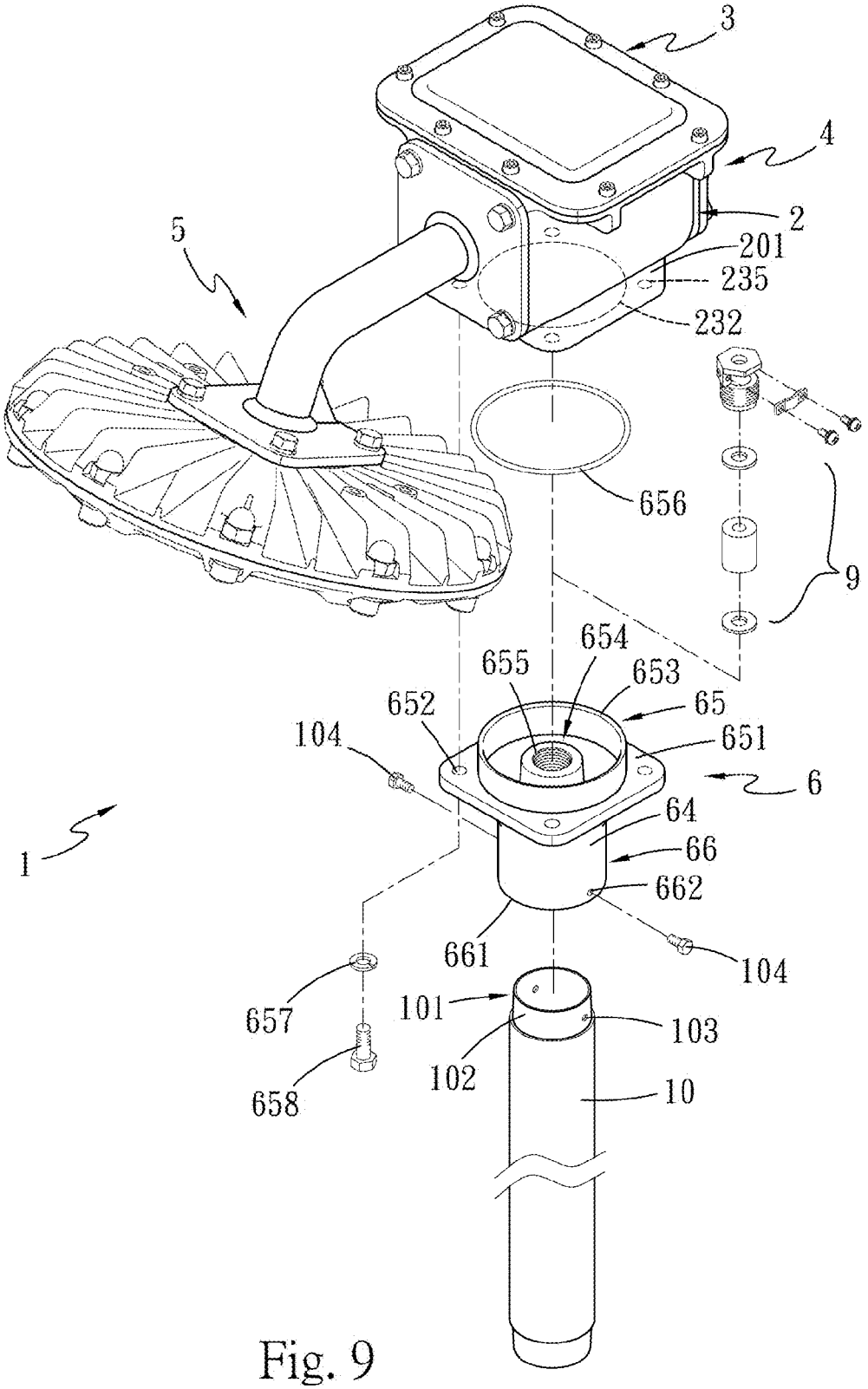
FIG. 9 is an exploded view of a fourth embodiment of the invention.
Figure 10:
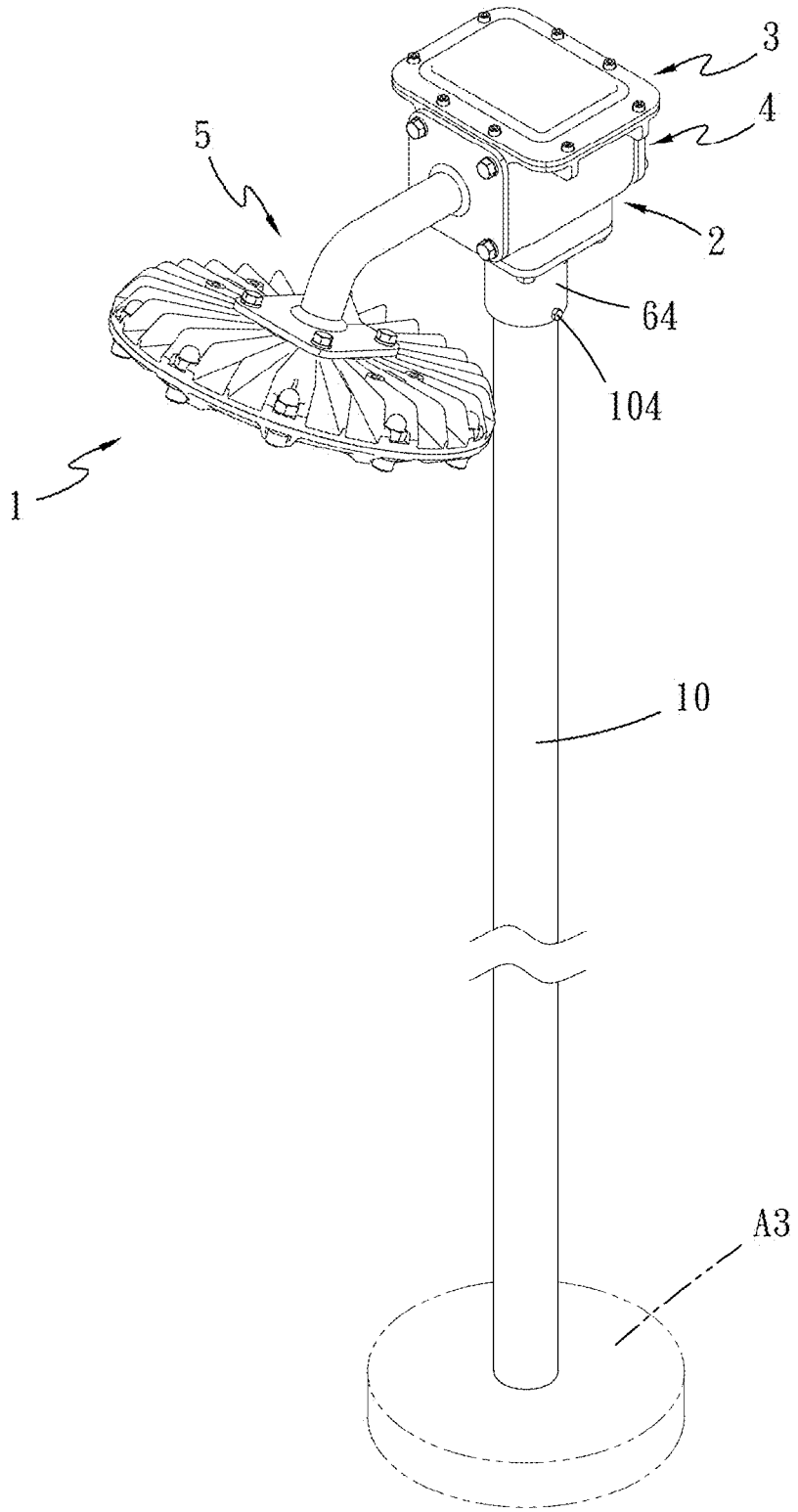
FIG. 10 is a perspective view of the fourth embodiment of the invention.

Please refer to FIGS. 9 and 10 for a fourth embodiment of the modular LED explosion-proof lamp 1 of the invention. Its essential portions are discussed as follow, while other details can be referred to the drawings and elaboration of the first embodiment previously discussed. In this embodiment the positioning assembly 6 includes a hollow tubular assembly 64 to bridge the rear protruding coupling portion 201 and a post 10, and a fifth connection ring 656 to bridge the rear protruding coupling portion 201 and an upper end of the tubular assembly 64. The tubular assembly 64 includes a third coupling portion 65 at one end thereof connected to the second coupling port 232 and a fourth coupling portion 66 at another end remote from the third coupling portion 65. The third coupling portion 65 has a fourth protruding plate 651 leaned on the rear protruding coupling portion 201 of the body 2, a plurality of twentieth fastening holes 652 located on the fourth protruding plate 651 and faced the second fastening holes 235, a fifth protruding portion 653 connected to the fourth protruding plate 651 and faced the second coupling port 232 to couple therewith, a sixth chamber 654 faced the fifth protruding portion 653 inward, a screw hole 655 faced the sixth chamber 654 to screw with the cable sealing means 9, and a plurality of twelfth fasteners 658 each runs through a seventh washer 657 and each twentieth fastening hole 652 to fasten to each second fastening hole 235 so that the fourth protruding plate 651 can be fastened to the rear protruding coupling portion 201. The fourth coupling portion 66 has a circular opening 661 and a plurality of twenty first fastening holes 662 around and abutting the circular opening 661. The fifth connection ring 656 leans on the rear protruding coupling portion 201 and the fifth protruding portion 653 to form sealing thereof.

In addition, the post 10 has a fifth coupling portion 101 at an upper end thereof connected to the fourth coupling portion 66. The fifth coupling portion 101 has a sixth protruding portion 102 faced the circular opening 661 to couple therewith, a plurality of twenty second fastening holes 103 located on the sixth protruding portion 102 and faced the twenty first fastening holes 662, and a plurality of thirteenth fasteners 104 each runs through each twenty first fastening hole 662 to fasten to each twenty second fastening hole 103 so that the sixth protruding portion 102 can be fastened to the circular opening 661. The post 10 has a lower end connected to a floor A3. In addition, the body 2, the electrical control assembly 3, the wiring box assembly 4 and the illumination unit 5 are electrically connected with each other.

Figure 11:
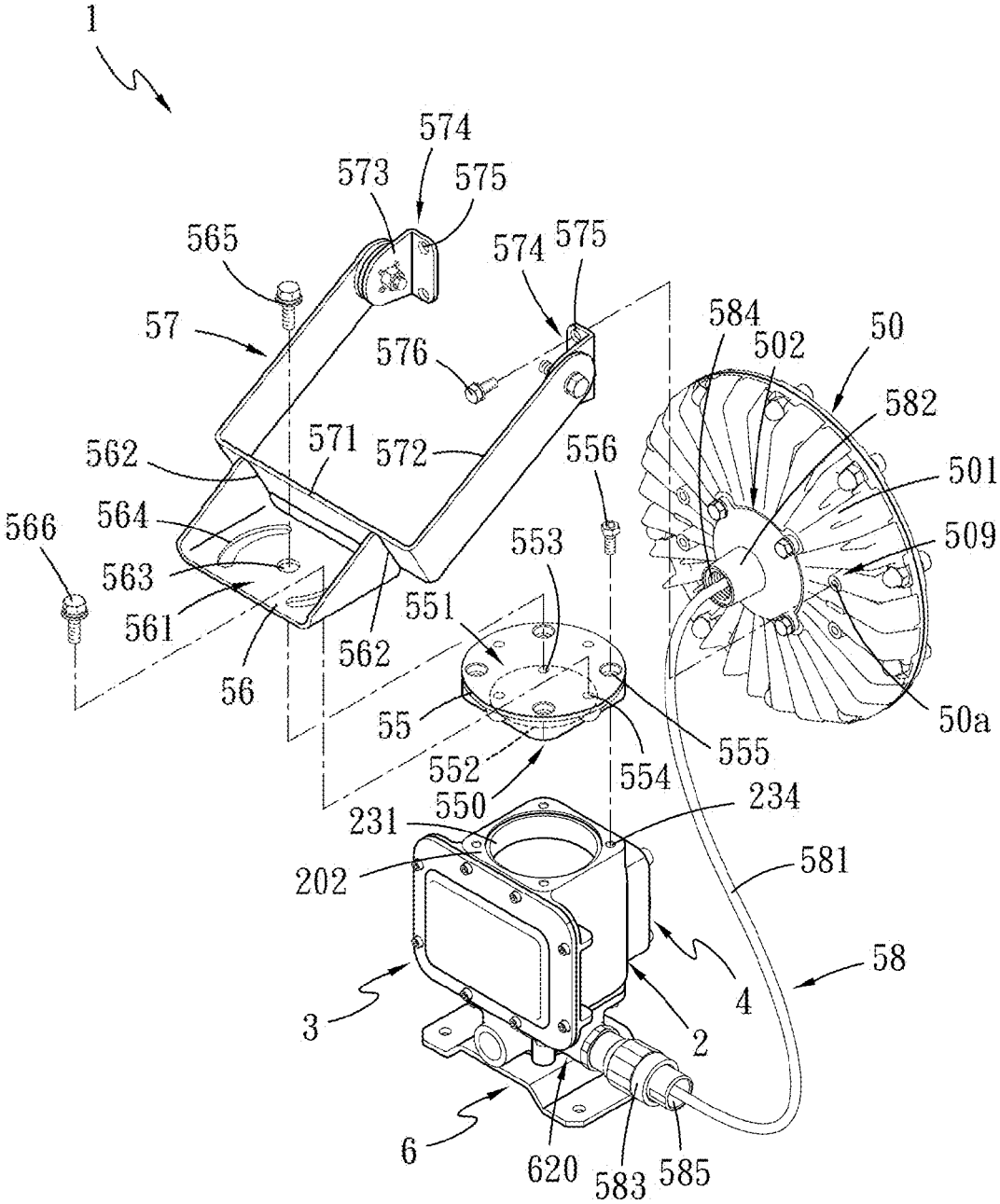
FIG. 11 is an exploded view of a fifth embodiment of the invention.
Figure 12:
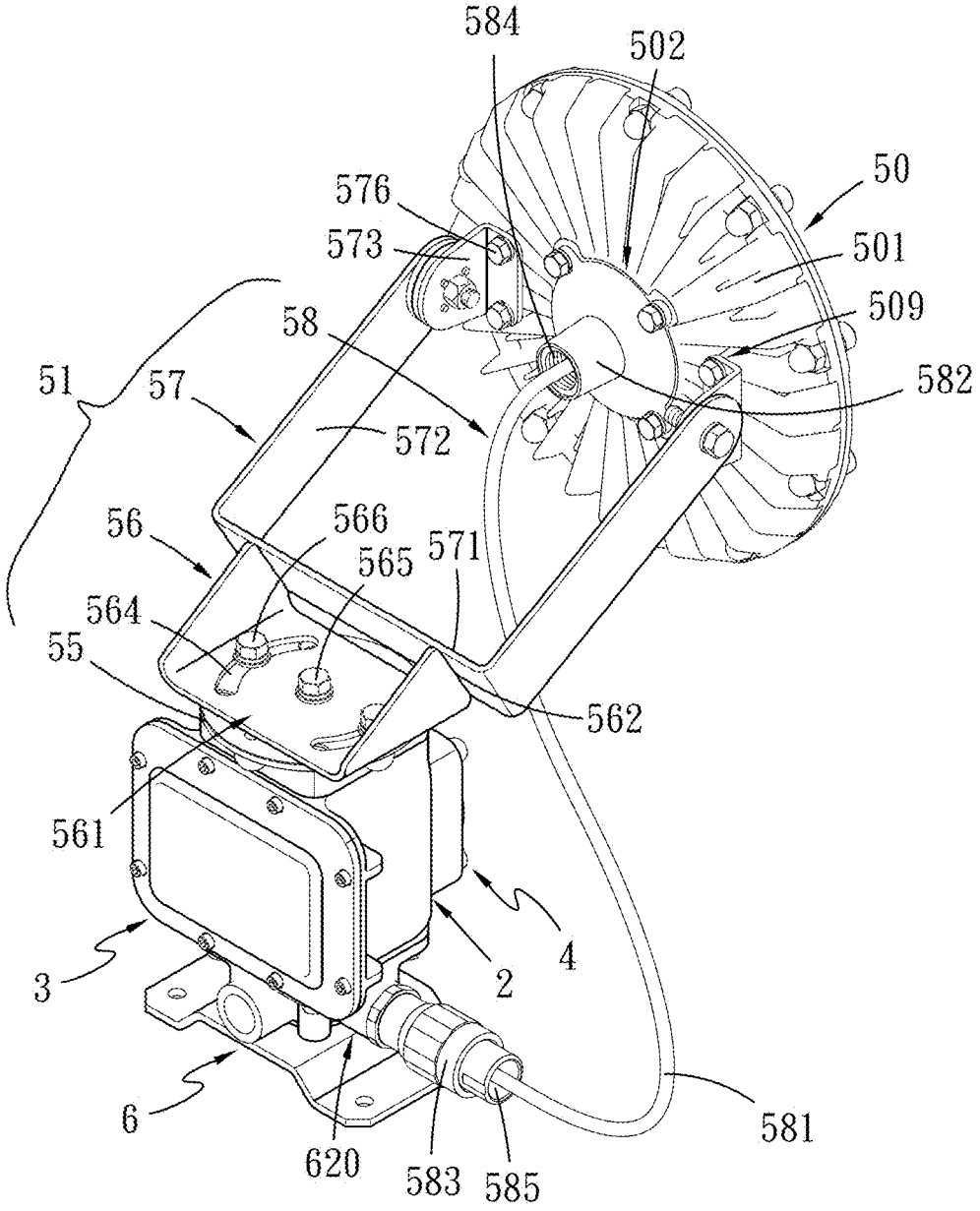
FIG. 12 is a perspective view of the fifth embodiment of the invention in an assembly condition.

Please refer to FIGS. 11 and 12 for a fifth embodiment of the modular LED explosion-proof lamp 1 of the invention. Its essential portions are discussed as follow, while the interconnection details can be referred to the drawings and elaboration of the first embodiment previously discussed. In this embodiment the base 501 of the illumination device 50 includes a plurality of fifth fastening portions 509 located at an outer side of the first fastening portion 502. Each fifth fastening portion 509 has a plurality of twenty third fastening holes 50*a*. The connection means 51 includes a tray 55 leaned on the transverse support portion 202 which has the first coupling port 231, a first coupling plate 56 connected to the tray 55, a bracket 57 connected to the first coupling plate 56 and the base 501, and a transmission assembly 58 connected to the positioning assembly 6 and the base 501. The tray 55 has a sixth coupling portion 550 at one end thereof connected to the first coupling port 231 and a sixth fastening portion 551 at another end connected to the first coupling plate 56. The sixth coupling portion 550 has a seventh protruding portion 552 faced the first coupling portion 231 to couple therewith. The sixth fastening portion 551 has a twenty fourth fastening hole 553 located in the middle thereof, a plurality of twenty fifth fastening holes 554 around the twenty fourth fastening hole 553, a plurality of sunken holes 555 faced the first fastening holes 234 and laid in a staggered manner outside the twenty fourth fastening hole 553 between the twenty fifth fastening holes 554, and a plurality of fourteenth fasteners 556 each runs through each sunken hole 555 to fasten to each first fastening hole 234 so that the tray 55 can be fastened to the transverse support portion 202 that has the first coupling port 231 formed thereon. The first coupling plate 56 includes a seventh fastening portion 561 on an upper surface thereof and two leaning edges 562 located on outer sides thereof and bent to connect to the bracket 57. The seventh fastening portion 561 has a twenty sixth fastening hole 563 located in the middle thereof and faced the twenty fourth fastening hole 553, two arched slots 564 located at two sides of the twenty sixth fastening hole 563 and formed at a diameter same as that of the twenty fifth fastening hole 554, a fifteenth fastener 565 run through the twenty sixth fastening hole 563 and fastened to the twenty fourth fastening hole 553, and two sixteenth fasteners 566 each runs through each arched slot 564 to fasten to each twenty fifth fastening hole 554 so that the first coupling plate 56 can be fastened to the tray 55. In addition, each fifteenth fastener 565 and each sixteenth fastener 566 can be hinged respectively on each twenty fourth fastening hole 553 and each twenty fifth fastening hole 554 to allow the first coupling plate 56 to turn and drive the bracket 57 and the base 501, thereby the illumination element 500 (also referring to the drawings of the first embodiment) can project to a wider range.

Furthermore, the bracket 57 includes a baseboard 571 connected to the leaning edges 562, two side boards 572 bent and connected to the baseboard 571, two second coupling plates 573 bent and located respectively at one end of each side board 572 remote from the baseboard 571, and two eighth fastening portions 574 located respectively on each second coupling plate 573 and connected to each fifth fastening portion 509. Each eighth fastening portion 574 has a plurality of twenty seventh fastening holes 575 faced and corresponding to the twenty third fastening holes 50*a*, and a plurality of seventeenth fasteners 576 each runs through each twenty seventh fastening hole 575 to fasten to each twenty third fastening hole 50*a*. The transmission assembly 58 includes a transmission member 581, a first coupling member 582 connected to one end of the transmission member 581 and fastened to the first fastening portion 502, and a second coupling member 583 connected to another end of the transmission member 581 remote from the first coupling member 582 and fastened to one protruding circular portion 620 of the positioning assembly 6. In this embodiment the transmission member 581 is, but not limited to, a cable. Moreover, the first coupling member 582 has a seventh chamber 584 run through by the transmission member 581 to allow the transmission member 581 and the illumination element 500 to form electrical connection. The second coupling member 585 has an eighth chamber 585 run through by the transmission member 581 to allow the transmission member 581 to form electrical connection with the body 2 through the positioning assembly 6. While the first through fourth embodiments provide illumination to a fixed range of area, the fifth embodiment is more flexible and can project to a wider range of area. To achieve a desired explosion-proof efficacy, the cable sealing means can be deployed on the base 501 and one protruding circular portion 602 where two ends of the transmission member 581 are joined to avoid exposure of sparks that might be generated inside that could otherwise cause hazardous incident of explosion. But this is not the limitation of the invention. In addition, the body 2, the electrical control assembly 3, the wiring box assembly 4 and the illumination device 50 are electrically connected with each other.

Furthermore, design of explosion-proof capability of the modular LED explosion-proof lamp 1 is accomplished via non-fully sealed condition of the body 2, but maintains a certain pressure relief condition to provide instantaneous release of pressure from the interior of the body 2 in the event that explosion takes place inside. Flames produced by the explosion are blocked by gaps formed practically to conform to Ingress Protection to secure safety on the outer side. In addition, in practice, the connection rings used from first embodiment through fifth embodiment also comply with Ingress Protection requirement.

As a conclusion, the body of the invention includes the first coupling port, the second coupling port and the third coupling port that are formed at the same diameter. The wiring box assembly, the illumination unit and the positioning assembly have respectively the second protruding portion, the third protruding portion and the first protruding portion to face and connect respectively to the first coupling port, the second coupling port or the third coupling port. By means of connecting to the first coupling port, the second coupling port or the third coupling port, a plurality of implementation alternatives can be provided for the modular LED explosion-proof lamp.

What is claimed is:

1. A modular LED explosion-proof lamp, comprising:

a body which includes a first chamber, a front protruding coupling portion located at one end thereof to connect to the first chamber, a rear protruding coupling portion opposite to the front protruding coupling portion to connect to the first chamber, two parallel transverse support portions connected to the front protruding coupling portion, the rear protruding coupling portion and the first chamber, and two parallel upright support portions connected to the front protruding coupling portion, the rear protruding coupling portion and the first chamber; wherein the front protruding coupling portion includes an opening communicating with the first chamber, one of the two transverse support portions includes a first coupling port communicating with the first chamber, the rear protruding coupling portion includes a second coupling port communicating with the first chamber, another one of two transverse support portions includes a third coupling port communicating with the first chamber, and the first coupling port, the second coupling port and the third coupling port are formed at a same diameter;

an electrical control assembly located in the first chamber;

a wiring box assembly selectively connected to the first coupling port, the second coupling port or the third coupling port;

an illumination unit including an illumination device and a connection device; the illumination device including a base and an illumination element connected to one end of the base; the connection device including a tube which includes a first coupling portion at one end thereof connected to the first coupling port, the second coupling port or the third coupling port, and a second coupling portion at another end thereof connected to one end of the base remote from the illumination element; and a positioning assembly including a first protruding plate which includes a first protruding portion connected to the first coupling port, the second coupling port or the third coupling port.

2. The modular LED explosion-proof lamp of claim 1, wherein the first coupling portion and the second coupling portion include respectively at least one screw hole to screw with a cable sealing device.

3. The modular LED explosion-proof lamp of claim 2, wherein the cable sealing device includes a compression element located in the screw hole, at least two washers located in the screw hole to press two ends of the compression element, a compact plug pressed one end of the compression element and screwed with the screw hole, and a clip element connected to the compact plug.

4. The modular LED explosion-proof lamp of claim 3, wherein the compression element is an explosion-proof rubber ring, and the compact plug is a metal plug.

5. The modular LED explosion-proof lamp of claim 1, wherein the wiring box assembly includes a power terminal deck, the power terminal deck, the electrical control assembly, the illumination unit and the positioning assembly being electrically connected with each other.

6. A modular LED explosion-proof lamp, comprising:

a body which includes a first chamber, a front protruding coupling portion located at one end thereof to connect to the first chamber, a rear protruding coupling portion opposite to the front protruding coupling portion to connect to the first chamber, two parallel transverse support portions connected to the front protruding coupling portion, the rear protruding coupling portion and the first chamber, and two parallel upright support portions connected to the front protruding coupling portion, the rear protruding coupling portion and the first chamber; wherein the front protruding coupling portion includes an opening communicating with the first chamber, one of the two transverse support portions includes a first coupling port communicating with the first chamber, the rear protruding coupling portion includes a second coupling port communicating with the first chamber, another one of two transverse support portions includes a third coupling port communicating with the first chamber, and the first coupling port, the second coupling port and the third coupling port are formed at a same diameter;

an electrical control assembly located in the first chamber;

a wiring box assembly selectively connected to the first coupling port, the second coupling port or the third coupling port;

an illumination unit including an illumination device and a connection device; the illumination device including a base and an illumination element connected to one end of the base; the connection device including a tube which includes a first coupling portion at one end thereof connected to the first coupling port, the second coupling port or the third coupling port, and a second coupling portion at another end thereof connected to one end of the base remote from the illumination element;

a positioning assembly including a tubular assembly which includes a third coupling portion at one end thereof to connect to the first coupling port, the second coupling port or the third coupling port, and a fourth coupling portion at an another end thereof remote from the third coupling portion; and a post which includes a fifth coupling portion connected to the fourth coupling portion.

7. The modular LED explosion-proof lamp of claim 6, wherein the first coupling portion, the second coupling portion and the third coupling portion include respectively at least one screw hole to screw with a cable sealing device.

8. The modular LED explosion-proof lamp of claim 7, wherein the cable sealing device includes a compression element located in the screw hole, at least two washers located in the screw hole to press two ends of the compression element, a compact plug pressed one end of the compression element and screwed with the screw hole, and a clip element connected to the compact plug.

9. The modular LED explosion-proof lamp of claim 8, wherein the compression element is an explosion-proof rubber ring, and the compact plug is a metal plug.

10. The modular LED explosion-proof lamp of claim 6, wherein the wiring box assembly includes a power terminal deck, the power terminal deck, the electrical control assembly, the illumination unit and the positioning assembly being electrically connected with each other.

* * * * *